US008604976B1

(12) United States Patent
Chang et al.

(10) Patent No.: US 8,604,976 B1
(45) Date of Patent: Dec. 10, 2013

(54) BROAD BEAM ANTENNA DESIGN FOR A TILTED PHASED ARRAY WITH PLATFORM MOTION

(75) Inventors: Kaichiang Chang, Northborough, MA (US); William Kennedy, Boston, MA (US)

(73) Assignee: Raytheon Company, Waltham, MA (US)

( * ) Notice: Subject to any disclaimer, the term of this patent is extended or adjusted under 35 U.S.C. 154(b) by 181 days.

(21) Appl. No.: 13/217,506

(22) Filed: Aug. 25, 2011

(51) Int. Cl.
*H01Q 3/00* (2006.01)

(52) U.S. Cl.
USPC ..... 342/377; 342/368; 342/373

(58) Field of Classification Search
USPC ..... 342/81, 154, 368, 372, 373, 377
See application file for complete search history.

(56) References Cited

U.S. PATENT DOCUMENTS 5,592,178 A 1/1997 Chang et al.
7,728,769 B2 6/2010 Chang et al.

OTHER PUBLICATIONS

Brown, G.C.; Kerce, J.C.; Mitchell, M.A.; "Extreme Beam Broadening using Phase Only Pattern Synthesis," Sensor Array and Multichannel Processing, Fourth IEEE Workshop on, pp. 36-39, Jul. 12-14, 2006 (DOI: 10.1109/SAM.2006.1706079).

*Primary Examiner* — Dao Phan
(74) *Attorney, Agent, or Firm* — Daly, Crowly, Mofford & Durkee, LLP

(57) ABSTRACT

Embodiments of the present invention are directed to techniques and systems for modifying the transmit beam of a phased array antenna in order to effect a shape change in the beam that pre-compensates for platform motion and clutter considerations in the local environment. The techniques and systems herein disclosed take advantage of the phase controlling capability of phased array antennas to adjust the performance of each element in a way that de-focuses or spoils the transmit beam. This spoiling, in turn, enables the transmission of a broader, tailored beam that provides illumination over an area that would otherwise require multiple scans from narrow transmit beams. The techniques described provide a closed-form solution that sacrifices some antenna pattern efficiency in exchange for greatly reduced computational complexity over prior art, optimal search techniques.

15 Claims, 5 Drawing Sheets

BROAD BEAM ANTENNA DESIGN FOR A TILTED PHASED ARRAY WITH PLATFORM MOTION

FIELD OF THE INVENTION

This concepts and systems described herein relate generally to phased array antennas and more particularly to phased array antennas disposed on moving platforms including, but not limited to, ships and aircraft.

BACKGROUND

As is known in the art, a phased array antenna includes a plurality of antenna elements spaced apart from each other by known distances coupled through a plurality of phase shifter circuits to either or both of a transmitter or receiver. In some cases, the phase shifter circuits are considered part of the transmitter and/or receiver.

As is also known, phased array antenna systems are adapted to produce a beam of radio frequency energy (RF) and direct such beam along a selected direction by controlling the phase (via the phase shifter circuitry) of the RF energy passing between the transmitter or receiver and the array of antenna elements. In an electronically scanned phased array, the phase of the phase shifter circuits (and thus the beam direction) is set by sending a control signal or word to each of the phase shifter sections. The control word is typically a digital signal representative of a desired phase shift and may comprise a desired attenuation level and other control data.

Phased array antennas are often used in both defense and commercial electronic systems. For example, Active, Electronically Scanned Arrays (AESAs) are in demand for a wide range of defense and commercial electronic systems such as radar surveillance and track, terrestrial and satellite communications, mobile telephony, navigation, identification, and electronic counter measures. Military radar systems often require both long range operation for Ballistic Missile Defense (BMD) missions (requiring fully focused, high sensitivity beam patterns) and short range operation for volume surveillance missions (requiring spatially broadened beams to scan the surveillance volume faster). Such systems may also be used for electronic warfare (EW) and intelligence collection. Thus, the systems are often deployed on a single structure such as a ship, aircraft, missile system, missile platform, satellite, or a building.

When a phased array is deployed on a moveable platform (e.g., ship and airborne radar systems) it is often necessary to account for platform movement (e.g., ship pitch and roll) when pointing an antenna beam. Additionally, signal filtering or suppression to remove surface (horizon) clutter, electronic jamming, and other effects is typically necessary.

Many conventional phased array antennas accommodate movement by the use of agile beamforming and/or stabilized antenna mountings. However, such systems may be overly expensive or infeasible in the case of very large, high-powered phased arrays used for long-range surveillance. When the phased array antenna is mounted on the superstructure of a ship, for example, typical stabilization schemes are not possible. Often, existing algorithms employed to solve these problems employ an iterative "optimal search" scheme. In such applications, each antenna pattern variation or shaping for motion compensation requires independent real-time processing which becomes computationally intractable with narrow beam operation.

The combination of the long-range BMD and the short-range surveillance missions also poses a number of challenges to digital beamforming (DBF) in phased array systems. The typical high-power beam used for long-range searching is too narrow to effectively provide the large volume, rapid coverage needs of the short-range surveillance tasking. Although multiple simultaneous receive beams are typically formed to reduce occupancy time (and thereby improve volumetric coverage), such systems lack a sufficiently large transmit beam footprint to provide the necessary search coverage on time.

What is needed is an enhanced DBF approach capable of providing a flexible, broad beam transmit capability on a moving platform that can operate with multiple-beam simultaneous receive to provide clutter mitigation and pattern canting/shaping for motion compensation.

SUMMARY

In contrast to the above-described conventional approaches, embodiments of the concepts and apparatus described herein are directed to techniques and systems for "spoiling" (or modifying from optimal configuration) the transmit beam of a phased array antenna in order to effect a shape change in the beam that pre-compensates for platform motion and clutter considerations in the local environment. The techniques and systems herein disclosed take advantage of the phase controlling capability of modern, high-power phased array elements to adjust the performance of each element in a way that de-focuses or spoils the transmit beam. This spoiling, in turn, enables the transmission of a broader, tailored beam that provides illumination over an area that would otherwise require multiple scans from the (normally) highly-focused, narrow transmit beams. The techniques described provide a closed-form solution that sacrifices some antenna pattern efficiency in exchange for greatly reduced computational complexity over prior art, optimal search techniques.

BRIEF DESCRIPTION OF THE DRAWINGS

The foregoing and other objects, features and advantages of the concepts and apparatus described herein will be apparent from the following description of particular embodiments, as illustrated in the accompanying drawings in which like reference characters refer to the same parts throughout the different views. The drawings are not necessarily to scale, emphasis instead being placed upon illustrating the principles of the concepts and apparatus described herein.

DETAILED DESCRIPTION

Embodiments of the concepts and apparatus described herein are directed to techniques and systems for "spoiling"

(or modifying from optimal configuration) the transmit beam of a phased array antenna in order to effect a shape change in the beam that pre-compensates for platform motion and clutter considerations in the local environment. The techniques and systems herein disclosed take advantage of the phase controlling capability of modern, high-power phased array elements to adjust the performance of each element in a way that de-focuses or spoils the transmit beam. This spoiling, in turn, enables the transmission of a broader, tailored beam that provides illumination over an area that would otherwise require multiple scans from the (normally) highly-focused, narrow transmit beams. The techniques described provide a closed-form solution that sacrifices some antenna pattern efficiency in exchange for greatly reduced computational complexity over prior art, optimal search techniques.

Figure 1:
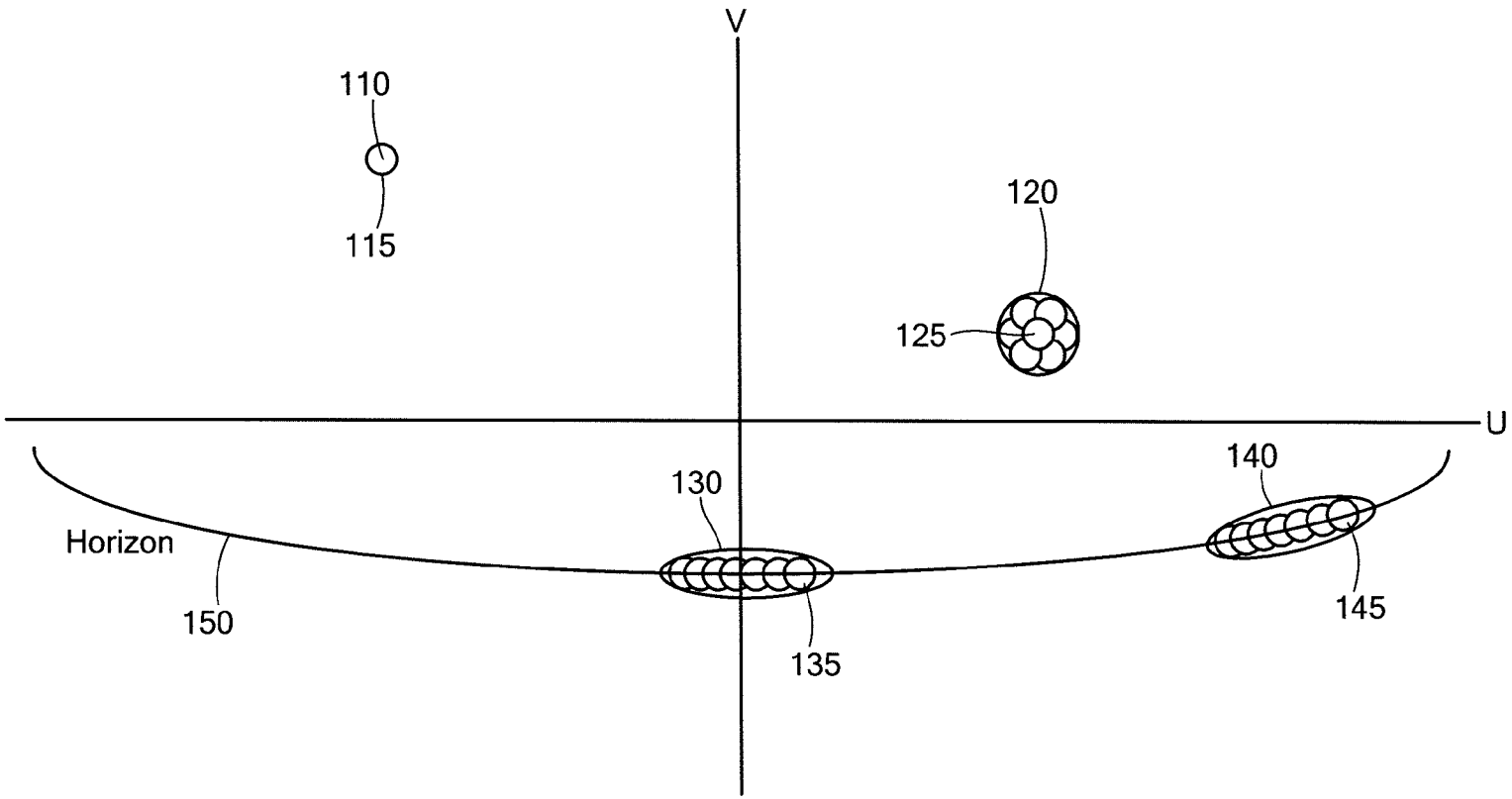
FIG. 1 is a diagram of some representative beam patterns as seen in array coordinates, both unspoiled and spoiled.

Digital beamforming (DBF) techniques may be used at the element (or sub-array/sub-aperture of elements) level to provide the necessary multiple simultaneous receive beams for radar applications employing transmit beam spoiling. In such applications, the receive beam (or beams) must be synchronized in both time and space in order to receive a return signal from the target(s). However, such an application requires flexibility in the modes and directions of transmit beam spoiling in order to take advantage of the receive-side DBF. For example, transmit spoiling in one or two dimensions and/or pattern canting (angular rotation around beam center or boresight) may be used to accommodate platform motion and/or local clutter. Digital beamforming in the receive beams may then be used to match the number and composite coverage of the receive beams to the spoiled pattern. FIG. 1 illustrates some of these scenarios.

The unspoiled transmit beam 110 in the upper left quadrant represents a nominal spot beam shape and relative size for a high-power phased array antenna. The corresponding receive beam 115 superimposed thereon illustrates the difficulty of covering a large volume of space with the narrow beam. Using the systems and techniques herein disclosed, a transmit beam may be spoiled in two dimensions (u and v) resulting in a much larger illuminated region 120 as shown. Here, the beam spoiling factor (BSF) is roughly equal in both axes, resulting in a circular spoiled pattern. A plurality of receive beams 125 (here shown as seven beams) operating in simultaneous receive mode, covers the wider, spoiled area. Of course, the BSF applied in each axis need not be equal, which would give transmit patterns of elliptical shape.

A single dimension of beam spoiling may be illustrated by transmit beam 130, which is (in this example) spread out horizontally along the aperture's visible horizon 150. Again, a plurality of simultaneous receive beams 135 may be employed to identify and track targets illuminated by the wider transmit beam 130.

Finally, a canted 1-D beam broadening may be illustrated by transmit beam 140. As in the case of transmit beam 130, the beam is spread out in one dimension. However, the pattern may be canted to follow the visible horizon 150 by using one-dimensional beam spoiling along the axis of canting. A corresponding plurality of simultaneous receive beams 145 may be employed to identify and track targets illuminated by the wider transmit beam 140.

In general, the spoiled transmit beam will be effective whenever the transmit loss incurred by spoiling (due to the "inefficient" power distribution relative to the unspoiled spot beam) may be less than or equal to the geometric loss due to the off-boresight location of the target.

While the techniques and systems disclosed herein are generally described with reference to the transmit direction, one of ordinary skill in the art will readily see that these techniques are equally applicable to spoiling in the receive direction. Such embodiments may provide broad area receive coverage with arbitrary alignment with the horizon or another reference orientation and similar clutter mitigation properties. Accordingly, the concepts and apparatus described herein are not limited in their applicability to either the transmit or receive directions.

One of ordinary skill in phased array antenna applications will also appreciate that the systems and techniques herein described are applicable to a wide range of such application beyond radar. Various communications (including search and rescue [SAR]), electronic warfare, and signals intelligence applications may also employ the concepts and apparatus described herein. Accordingly, the concepts, systems, and techniques described herein are not limited to any particular phased array antenna application, nor to any particular operating frequency band or bands.

Some examples of the prior art in iterative gradient descent searches are discussed in Brown, G. C.; Kerce, J. C.; Mitchell, M. A.; "Extreme Beam Broadening using Phase Only Pattern Synthesis," Sensor Array and Multichannel Processing, Fourth IEEE Workshop on, pp. 36-39, 12-14 Jul. 2006 (DOI: 10.1109/SAM.2006.1706079), incorporated herein by reference in its entirety. These approaches are computationally expensive and require the use of stored, pre-calculated or otherwise quantized patterns. Accordingly, these prior art methods are not well-suited to the real-time needs of long-range BMD or theatre defense missions employing a narrow beam antenna array.

By contrast, in some exemplary embodiments of the concepts and apparatus described herein, the beam broadening approach may be based on a combination of a homotropy from a known optimal beam with BSF-1 for a perturbation stable solution of broadening phase values and a stochastic gradient descent technique used to optimize the cost functional for a more realistic aperture having irregular shape. This novel approach is further described below.

Figure 2:
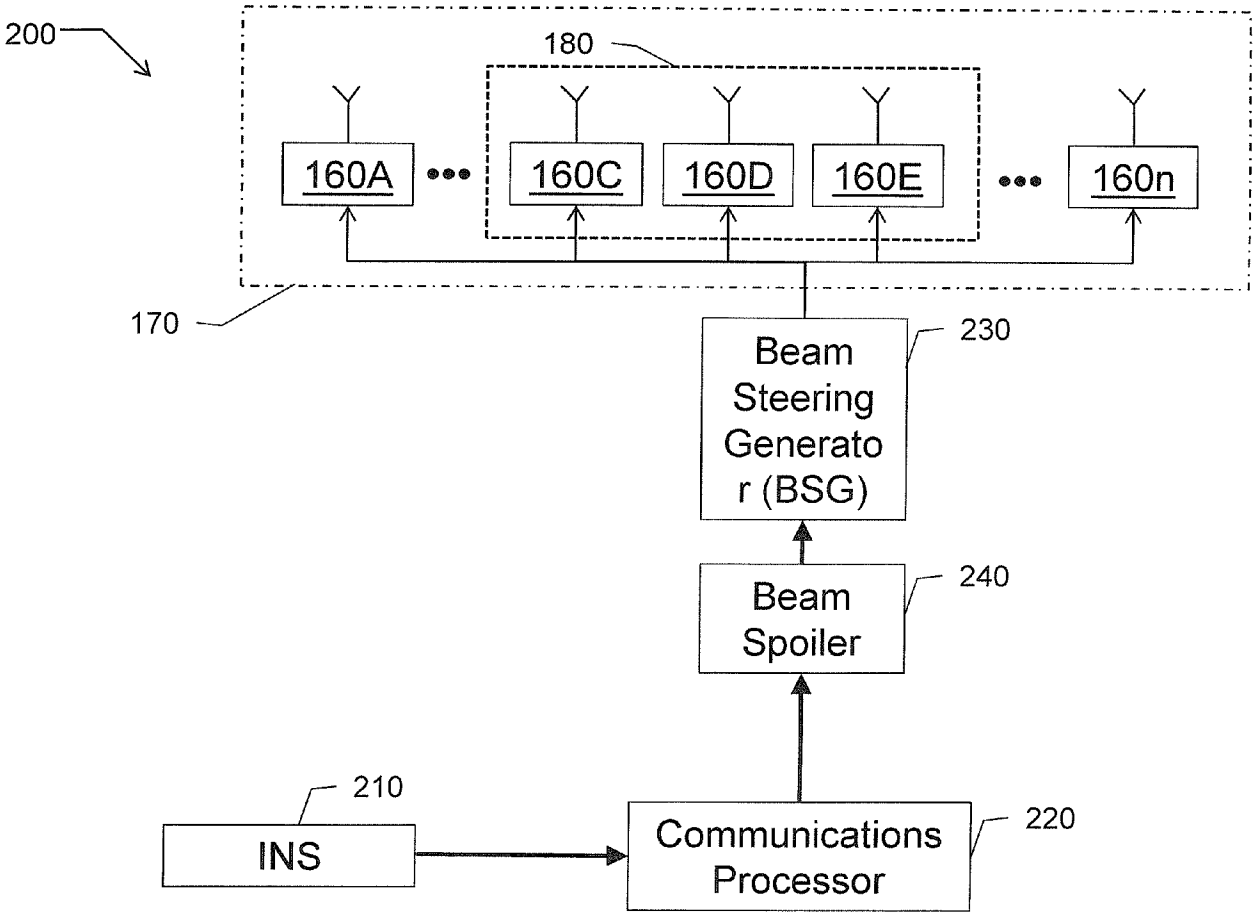
FIG. 2 is a high-level block diagram of a phased array antenna system, including the associated beam steering components, according to one embodiment of the present invention.

An exemplary embodiment of a system 200 constructed according to the teachings herein is depicted as a high-level block diagram in FIG. 2. The platform motion inputs are represented by the well-known signals from a commonly-employed inertial navigation system (INS) 210 to communications processor 220. Communications processor 220 may, in some embodiments, comprise a radar processor or similar control device as are currently known and used n the art.

Communications processor 220 conveys the beam direction vector, spoiling direction vector, magnitude (i.e., the beam spoiling factor), and (in some embodiments) a dimensionality indicator (i.e., 1-D or 2-D shape) to the beam steering generator (BSG) 230. In one exemplary embodiment, the beam spoiler 240 may be a component of the BSG. Alternatively, the beam spoiler may be implemented in a separate unit or module configured as a pre-processor to the BSG 230.

Beam spoiler 240 utilizes the input signals fro INS 210 and communications processor 220 to determine adjusted phase weights necessary to spoil the beam and conveys these weights to BSG 230 for the completion of the conventional phased array beamforming computations. BSG 230 in turn drives elements 160A-160N of phased array aperture 170. Note that elements 160D through 160H here represent of the elements in sub-aperture 180.

Figure 3:
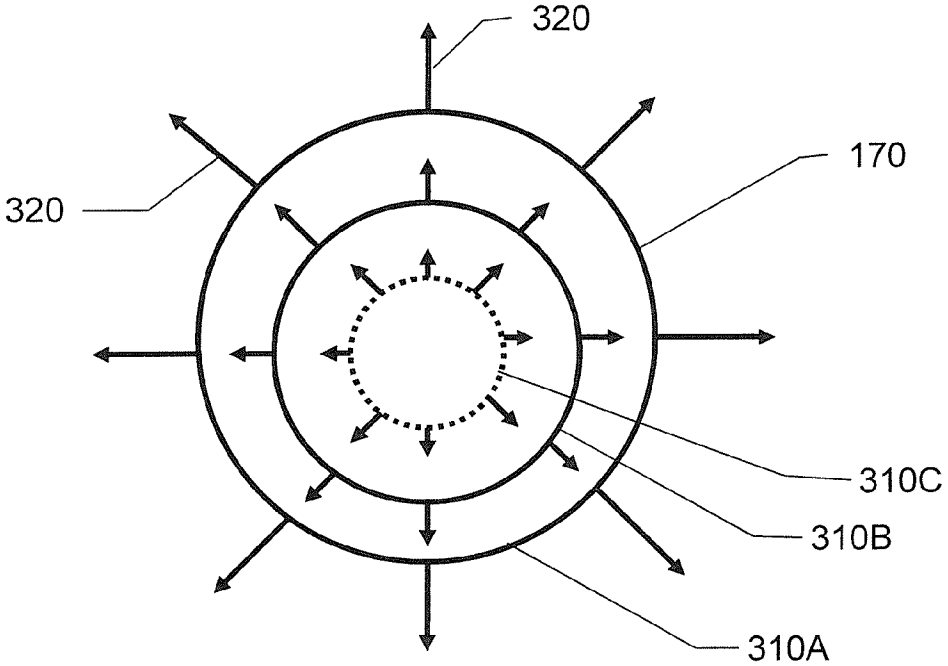
FIG. 3 is an illustration of the application of the beam steering vector to a plurality of sub-apertures, according to one embodiment of the present invention.

In one exemplary embodiment, aperture 170 may be partitioned into a number of concentric sub-apertures 180, arranged as shown in FIG. 3. FIG. 3 depicts three sub-apertures (SAs) 310A, 310B, and 310C, but in general two or more may be employed. Also, as the number of SAs increase, the ripple (non-homogeneity) of the resulting pattern decreases, which may be advantageous in most system configurations. It should be noted that the present techniques are not limited to circular apertures or circular sub-apertures, but may be broadly applicable to all arrays. Depending on BSF value and pattern ripple requirement, the number of sub-apertures may range from a minimum of 1 to a maximum of the square root of the number of elements times $\pi$.

As is further described below, beam spoiler 240 determines the spoiling direction, magnitude, and shape by which the system will spoil or broaden the beam based on the platform's tracking algorithm, surveillance map and platform motion status. The magnitude of the effect may be referred to herein as the beam spoiling factor (BSF) and is equal to the spoiled beamwidth divided by the non-spoiled beamwidth. The shape of the broadening depends on the application, and may be defined as either one or two-dimensional, denoting broadening in either one or both axes normal to the boresight. (These orthogonal co-planar dimensions are conventionally referred to as the u- and v-axes [or azimuth and elevation] in the horesight coordinate frame of reference and are mutually perpendicular to the direction of propagation of a transmit wavefront.) Table 1 defines some exemplary one and two-dimensional (1-D and 2-D, respectively) spoiling in terms of (u, v) coordinates.

TABLE 1

| Description | Beam Steering Conditions |
|---|---|
| 2-D Spoiling ($k_i$ constant) | $\sqrt{(u_{spoil})^2+(v_{spoil})^2} = k_i$ |
| 1-D Spoiling in Azimuth | $u_{spoil} = k_i$<br>$v_{spoil} = 0$ |
| 1-D Spoiling in Elevation | $u_{spoil} = 0$<br>$v_{spoil} = k_i$ |
| Beam Spoiling with $\phi$ degree cant | $u_{spoil} = k_i * \cos(\phi)$<br>$v_{spoil} = k_i * \sin(\phi)$ |

The combination of the spoiling direction, magnitude, and shape forms a beam spoiling vector according to the equation:

$$\text{Beam Spoiling Vector} = BSF * S \quad \text{(Eqn. 1)}$$

where BSF=the beam spoiling factor=$\sqrt{(u_{spoil})^2+(v_{spoil})^2}=k_i$

S=the spoiling direction vector=$(u_{spoil}u_0+v_{spoil}v_0)/BSF$ $u_0$=unit vector in azimuth axis, $v_0$=unit vector in elevation axis $\phi$=the cant angle The spoiling direction factor S may be a function of a dimensionality indicator D, which is equal to 1 for either $u_{spoil}=0$ or $v_{spoil}=0$ or equal to 2 for $u_{spoil}, v_{spoil}\neq 0$. The use of this factor in defining S is optional.

In each sub-aperture, the specified beam steering vector (BSV) perturbs the beam in the direction of the BSV. Note that FIG. 3 shows a number of arrows (320) for each sub-aperture as representative of the wide range of beam spoiling vector directions and magnitudes possible. In practice, the selected beam spoiling factor and choice of one or two-dimensional spoiling completely determines a single vector for each sub-aperture.

In FIG. 3, the arrows 320 also illustrate different beam spoiling vectors in different sub-apertures. The length of the arrow may be proportional to the beam spoiling value and the direction of the arrow indicates the beam spoiling direction. For effective beam spoiling, the beam spoiling value must increase with increasing radial distance from the aperture center. The beam spoiling direction must always be divergent from the center of the array to produce beam spoiling, otherwise, beam squinting will occur instead of beam broadening. "Divergent" in this context means the spoiling direction is radially out from the center of the aperture. The spoiling value may be zero in some directions, however (i.e. resulting in no broadening in that dimension).

The beamforming element of the system then computes the individual phase weights for each element in each sub-aperture as follows:

$$\Phi_i = \frac{2\pi}{\lambda}(x_i u_{spoil} + y_i v_{spoil}) + \frac{2\pi}{\lambda}(x_i U_{steer} + y_i V_{steer}) \quad \text{(Eqn. 2)}$$

where $\phi_i$ represents the phase coefficient for each element i; $(x_i, y_i)$ represent the location of element i; and $(u_{spoil}, v_{spoil})$ represent the beam spoiling vector for the sub-aperture decomposed into its (u, v) coordinate components. $U_{steer}$ and $V_{steer}$ represent the standard beam steering vector for each element decomposed into its (u, v) coordinate components. The second term in Eqn, 2 represents the conventional beam steering component; the first term represents the beam spoiling contribution. These calculations may be performed in real-time, using the ship's (or the platform's, generally speaking) inertial navigation system (INS) for pattern placement and synthesis relative to array foresight.

The phase calculation of Eqn. 2 is repeated for each element in each sub-aperture via computation means well known in the digital beam steering art in, for example and not by way of limitation, a radar mission processor, beam steering computer, or other such system. Unlike in the prior art, where the computational time required is generally proportional to the square of the number of array elements, the present technique allows parallel computation of the phase weights for the beam spoiling component of Eqn. 2. In one exemplary embodiment, the radar mission processor calculates required beam "steer" direction from the target/surveillance direction and platform state (i.e., heading and inertial position; also referred to in terms of pitch/roll/yaw). The beam "spoil" parameters ($\phi$ and $k_i$, the BSF) are determined from the radar mode and the platform state. Based on the conventional tracking algorithm, surveillance map, and ship motion status, the radar processor calculates the beam spoiling vector according to Eqn. 2. The beam spoiling vector may be sent to the beam steering generator, which (on turn) computes the phase weights and sets the phase shift for each array element to produce the broadened transmit beam.

Experiments have shown that the spoiling transmit loss will be less than the array's geometric losses when the BSF is greater than 3. BSF values of less than 3 result in excessive spoiling losses and reduced efficacy.

Figure 4:
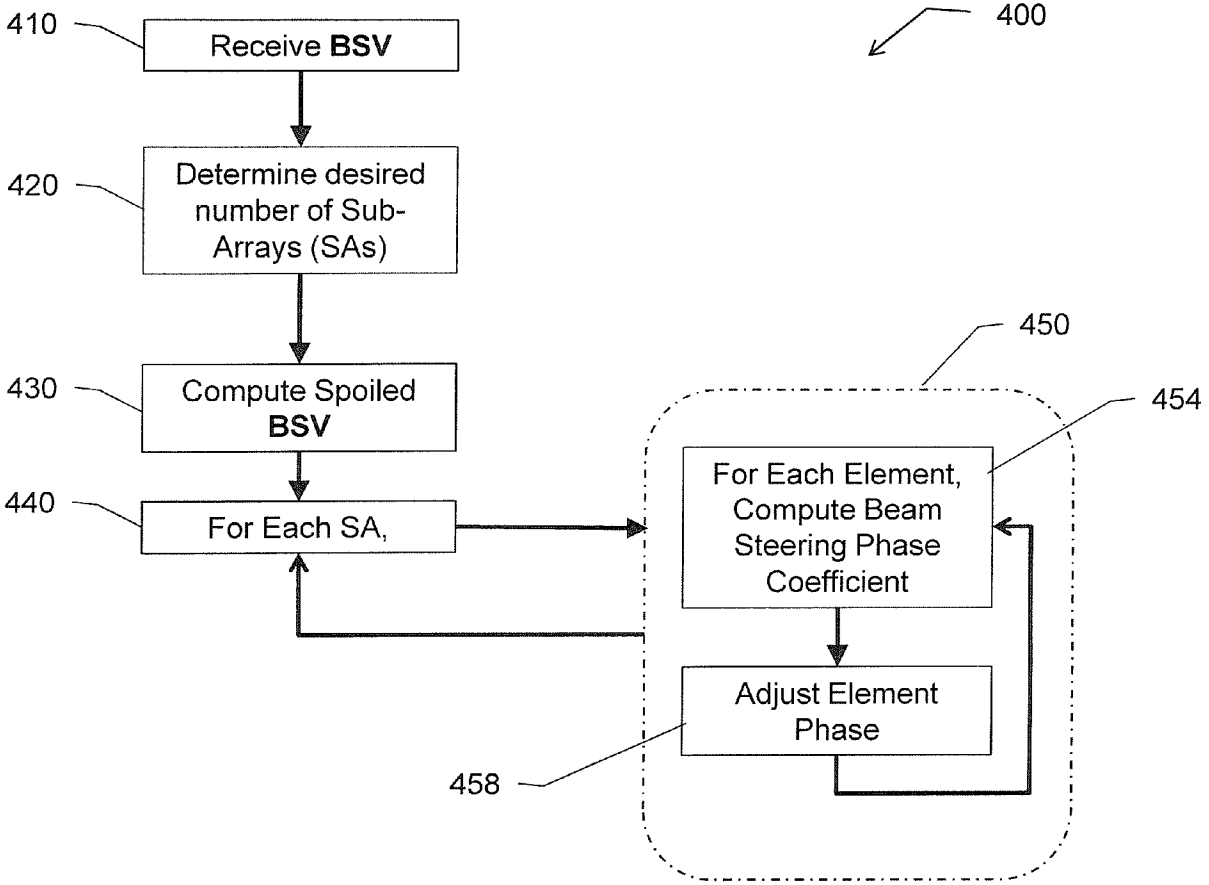
FIG. 4 is a flowchart of the process employed to compute the element phase weights for a beam spoiler according to one embodiment of the present invention.

FIG. 4 illustrates one exemplary embodiment of a computation flow 400 that may be employed to determine a spoiled beam steering vector and concomitant phase weightings for the elements of a phased array antenna system. The process 400 begins at step 410 with the receipt of the initial BSV for the array. Next, in step 420, the system determines the desired number of sub-apertures to employ in the beam spoiling calculation, based (as described above) on the magnitude of spoiling required (e.g., the BSF) and the desired/acceptable ripple. From this information, the spoiled BSV may be computed in step 430.

The iterative process of computing the appropriate array element phase weight (or coefficient) begins in step 440, where the phase coefficients for each element in the SA (step 454) are computed. As each element is adjusted by the phase coefficient (step 458), the process iterates for every element in the SA, step 450. As each SA is completed, the outer loop of the process (step 440) iterates for every sub-aperture until all computations are complete.

Figure 5:
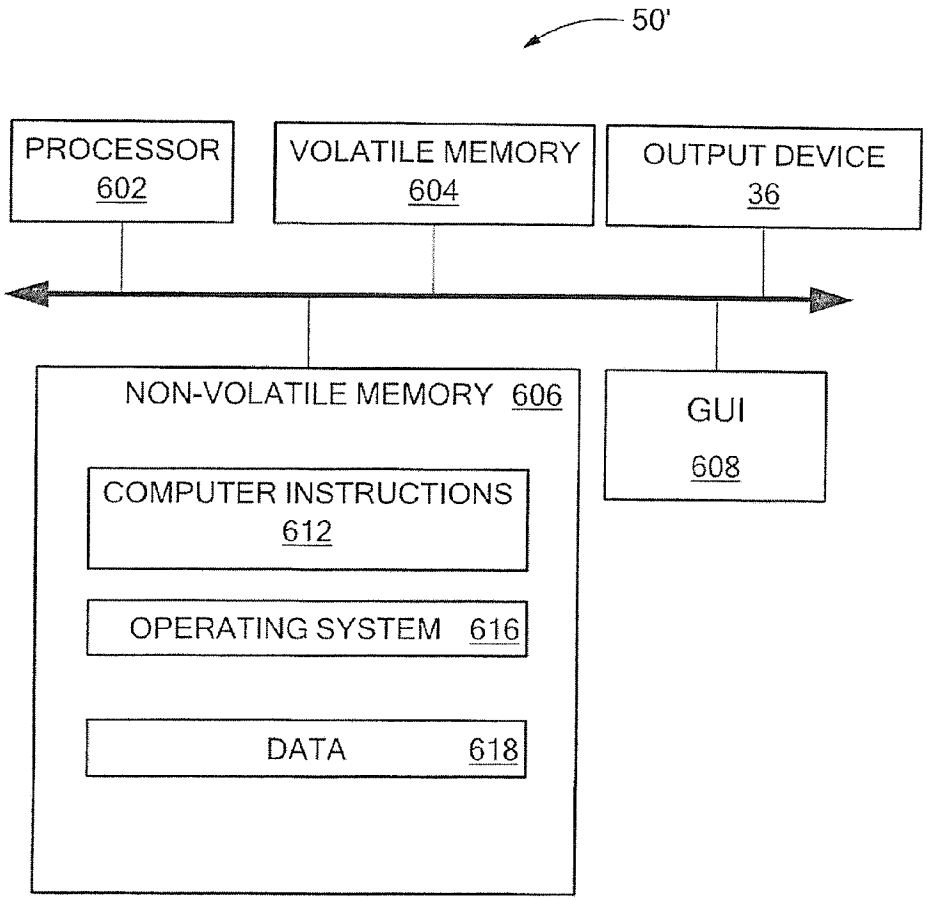
FIG. 5 is a high-level block diagram of a computer system adapted for use in some embodiments of the present invention.

Referring to FIG. 5, a computer includes a processor 602, a volatile memory 604, a non-volatile memory 606 (e.g., hard disk), and a graphical user interface (GUI) 608 (e.g., a mouse, a keyboard, a display, for example). The non-volatile memory 606 stores computer instructions 612, an operating system 616 and data specific to the application 618, for example. In one example, the computer instructions 612 are executed by the processor 602 out of volatile memory 604 to perform all or part of the processes described herein.

The processes described herein are not limited to use with the hardware and software of FIG. 5; they may find applicability in any computing or processing environment and with any type of machine or set of machines that is capable of running a computer program. The processes described herein may be implemented in hardware, software, or a combination of the two. The processes described herein may be implemented in computer programs executed on programmable computers/machines that each includes a processor, a storage medium or other article of manufacture that is readable by the processor (including volatile and non-volatile memory and/or storage elements), at least one input device, and one or more output devices. Program code may be applied to data entered using an input device to perform The processes described herein and to generate output information.

The system may be implemented, at least in part, via a computer program product, (e.g., in a machine-readable storage device), for execution by, or to control the operation of, data processing apparatus (e.g., a programmable processor, a computer, or multiple computers). Each such program may be implemented in a high level procedural or object-oriented programming language to communicate with a computer system. However, the programs may be implemented in assembly or machine language. The language may be a compiled or an interpreted language and it may be deployed in any form, including as a stand-alone program or as a module, component, subroutine, or other unit suitable for use in a computing environment. A computer program may be deployed to be executed on one computer or on multiple computers at one site or distributed across multiple sites and interconnected by a communication network. A computer program may be stored on a storage medium or device (e.g., DVD, CD-ROM, hard disk, or magnetic diskette) that is readable by a general or special purpose programmable computer for configuring and operating the computer when the storage medium or device is read by the computer to perform the processes described herein. The processes described herein may also be implemented as a machine-readable storage medium, configured with a non-transitory computer program, where upon execution, instructions in the computer program cause the computer to operate in accordance with processes 300 and 550.

The processing blocks associated with implementing the system may be performed by one or more programmable processors executing one or more computer programs to perform the functions of the system. All or part of the system may be implemented as, special purpose logic circuitry (e.g., an field programmable gate array [FPGA] and/or an application-specific integrated circuit [ASIC]).

Elements of different embodiments described herein may be combined to form other embodiments not specifically set forth above. Other embodiments not specifically described herein are also within the scope of the following claims.

The order in which the steps of the present method are performed is purely illustrative in nature. In fact, the steps can be performed in any order or in parallel, unless otherwise indicated by the present disclosure.

The method of the present invention may be performed in either hardware, software, or any combination thereof, as those terms are known in the art. In particular, the present method may be carried out by software, firmware, and/or microcode operating on a computer or processor (or plural elements thereof) of any type. Additionally, software embodying the concepts described herein may comprise computer instructions in any non-transitory form (e.g., source code, object code, and/or interpreted code, etc.) stored in any computer-readable medium. Accordingly, the implementation of the concepts and apparatus described herein is not limited to any particular platform, unless specifically stated otherwise in the present disclosure.

While particular embodiments of the present concepts and apparatus have been shown and described, it will be apparent to those skilled in the art that various changes and modifications in form and details may be made therein without departing from the spirit and scope of the invention as defined by the following claims. Accordingly, the appended claims encompass within their scope all such changes and modifications.

We claim:

1. In a beamforming apparatus for a phased array antenna, a method for beamforming in a phased array antenna having a total aperture, comprising:

receiving a specified beam steering vector (BSV);

determining a number of concentric sub-apertures based upon a beam spoiling vector associated with said BSV;

dividing the total aperture into the determined number of concentric sub-apertures;

computing a spoiled BSV for at least one of two orthogonal co-planar dimensions perpendicular to the direction of propagation of a transmit wavefront based on the BSV;

applying the spoiled BSV in divergent directions for each sub-aperture by:

for each element i in each of said sub-apertures, computing a beam steering phase coefficient, where said beam steering phase coefficient is determined by the equation $$\Phi_i = \frac{2\pi}{\lambda}(x_i u_{spoil} + y_i v_{spoil}) + \frac{2\pi}{\lambda}(x_i U_{steer} + y_i V_{steer})$$

wherein $(x_i, y_i)$ denote the location of element i and $(u_{spoil}, v_{spoil})$ denote the spoiled BSV in sine space coordinates; and adjusting the phase of each element in said array by said respective beam steering phase coefficients to spoil the transmit beam;

wherein said spoiling compensates for at least one of platform motion and local clutter.

2. The method of claim 1, wherein the number of sub-apertures is determined by the desired level of non-homogeneity across the total aperture.

3. The method of claim 1, wherein the number of sub-apertures range from one to the square root of the number of elements in the total aperture times $\pi$.

4. The method of claim 1, wherein said sub-aperture beam steering phase coefficient computation is performed in parallel for all said sub-apertures.

5. An apparatus for beam forming in a phased array antenna having a total aperture, comprising:

a communications processor configured to process INS data to determine a beam pointing vector and a beam spoiling vector;

a beam spoiler operatively connected to said communications processor and configured to compute phase coefficients for each element in said total aperture based at least in part on said beam spoiling vector;

a beam steering generator operative coupled to said beam spoiler and said phased array antenna elements and configured to steer said phased array antenna with at least said phase coefficients.

6. The apparatus of claim 5, wherein said total aperture further comprises one or more sub-apertures and wherein said beam spoiler computes said phase coefficients for each element in each of said one or more sub-apertures.

7. The apparatus of claim 6, wherein said sub-aperture phase coefficient computation is performed in parallel for all said sub-apertures.

8. An apparatus for beamforming in a phased array antenna having a total aperture, comprising:

means for receiving a specified beam steering vector (BSV);

means for determining a number of concentric sub-apertures based upon a beam spoiling vector associated with said BSV;

means for dividing the total aperture into the determined number of concentric sub-apertures;

means for computing a spoiled BSV for at least one of two orthogonal co-planar dimensions perpendicular to the direction of propagation of a transmit wavefront based on the BSV;

means for applying the spoiled BSV in divergent directions for each sub-aperture by:

for each element i in each of said sub-apertures, computing a beam steering phase coefficient, where said beam steering phase coefficient is determined by the equation $$\Phi_i = \frac{2\pi}{\lambda}(x_i u_{spoil} + y_i v_{spoil}) + \frac{2\pi}{\lambda}(x_i U_{steer} + y_i V_{steer})$$

wherein $(x_i, y_i)$ denote the location of element i and $(u_{spoil}, v_{spoil})$ denote the spoiled BSV in sine space coordinates; and adjusting the phase of each element in said array by said respective beam steering phase coefficients to spoil the transmit beam;

wherein said spoiling compensates for at least one of platform motion and local clutter.

9. The apparatus of claim 8, wherein the number of sub-apertures is determined by the desired level of non-homogeneity across the total aperture.

10. The apparatus of claim 8, wherein the number of sub-apertures range from one to the square root of the number of elements in the total aperture times $\pi$.

11. The apparatus of claim 8, wherein said sub-aperture beam steering phase coefficient computation is performed in parallel for all said sub-apertures.

12. A computer-readable medium storing a non-transitory computer program executable by at least one computer, the computer program comprising computer instructions for in a phased array antenna having a total aperture:

receiving a specified beam steering vector (BSV);

determining a number of concentric sub-apertures based upon a beam spoiling vector associated with said BSV;

dividing the total aperture into the determined number of concentric sub-apertures;

computing a spoiled BSV for at least one of two orthogonal co-planar dimensions perpendicular to the direction of propagation of a transmit wavefront based on the BSV;

applying the spoiled BSV in divergent directions for each sub-aperture by:

for each element i in each of said sub-apertures, computing a beam steering phase coefficient, where said beam steering phase coefficient is determined by the equation $$\Phi_i = \frac{2\pi}{\lambda}(x_i u_{spoil} + y_i v_{spoil}) + \frac{2\pi}{\lambda}(x_i U_{steer} + y_i V_{steer})$$

wherein $(x_i, y_i)$ denote the location of element i and $(u_{spoil}, v_{spoil})$ denote the spoiled BSV in sine space coordinates; and adjusting the phase of each element in said array by said respective beam steering phase coefficients to spoil the transmit beam;

wherein said spoiling compensates for at least one of platform motion and local clutter.

13. The computer-readable medium of claim 12, wherein the number of sub-apertures is determined by the desired level of non-homogeneity across the total aperture.

14. The computer-readable medium of claim 12, wherein the number of sub-apertures range from one to the square root of the number of elements in the total aperture times $\pi$.

15. The computer-readable medium of claim 12, wherein said sub-aperture beam steering phase coefficient computation is performed in parallel for all said sub-apertures.

* * * * *